United States Patent [19]

Holm et al.

[11] 3,939,385

[45] Feb. 17, 1976

[54] SIGNALLING APPARATUS FOR SHIPS

[75] Inventors: Bengt Lennart Holm, Malmo; Gustav Rudolf Edelberg, Staffanstorp, both of Sweden

[73] Assignee: Kockums Mekaniska Verkstads AB, Malmo, Sweden

[22] Filed: Jan. 3, 1975

[21] Appl. No.: 538,275

[30] Foreign Application Priority Data

Jan. 4, 1974 Sweden ..... 7400075

[52] U.S. Cl. ..... 317/157; 340/287; 340/357

[51] Int. Cl.[2] ..... H01H 47/22

[58] Field of Search ..... 317/135, 157; 340/29, 74, 340/78, 309.5, 332, 356, 357, 287; 307/132 R, 132 M

[56] References Cited

UNITED STATES PATENTS 1,749,444 3/1930 Rae ..... 340/357

FOREIGN PATENTS OR APPLICATIONS 422,753 12/1925 Germany ..... 340/357

*Primary Examiner*—J. D. Miller
*Assistant Examiner*—Harry E. Moose, Jr.
*Attorney, Agent, or Firm*—Browne, Beveridge, DeGrandi & Kline

[57] ABSTRACT

A third relay is provided in a signalling apparatus for ships, the apparatus primarily being intended for signalling in poor visibility and comprising an electric signalling device connectable to a current source by means of a first relay, a plurality of alternatively selectable and periodically closable make contacts connected in parallel with each other and in series with the first relay to the current source, and a second self-holding relay for coupling the motor to the current source. The third relay is connected to the current source in series with a plurality of parallel-connected switches for manual signalling, has a break contact coupled into the holding current path of the second relay and at least one make contact for connecting the signalling device to the current source.

4 Claims, 6 Drawing Figures

SIGNALLING APPARATUS FOR SHIPS

The present invention relates to a signalling apparatus for ships, the apparatus being primarily intended for signalling in poor visibility and comprising an electric signalling device connectable to a current source by means of a first relay, a plurality of alternatively selectable make contacts which are connected in parallel with each other and in series with the first relay to the current source and are periodically closable by means of a motor, and a second self-holding relay for coupling the motor to the current source.

In the every-day use of such a signalling apparatus, the motor is started by manual connection of the current source to the second relay, whereupon a current path can be established through the signalling device by means of one of a plurality of manually closable selector switches each connected in series with its respective parallel-connected make contact. The motor is arranged to close the parallel-connected contacts with different predetermined and standardized periodicities thereby to obtain signalling patterns of different meaning from the signalling device. These signalling patterns are distinguished by the interval between, and possibly the length of, the signals emitted from the signalling device.

Suitably located switches are used to permit operation of the signalling device from points on the ship other than where the signalling apparatus is mounted The signalling device can be manually energized by means of these switches, at the same time as automatic signalling from the signalling apparatus is subsequently prevented so that a signalling pattern manually triggered from any point on the ship is not immediately followed by a further signal triggered from the motor-driven apparatus. To this end, these switches conventionally possess both breaking and closing functions and are connected to the signalling apparatus via three or four-wire lines which, apart from being relatively expensive, have caused both installational and operational problems, since these switches connected in a series circuit, provide a great many contacts at which faults can occur because of oxidation etc.

The object of the present invention is to provide an apparatus in the above-described signalling apparatus, as a result of which the above problems can be obviated and the signalling apparatus can be made functionally more reliable.

This object is achieved in that the apparatus is provided with at least one third relay which is connected to the current source in series with a plurality of parallel-connected switches for manual signalling, has a break contact coupled into the holding current path of the second relay and at least one make contact for connecting the signalling device to the current source.

Thus, in this manner the three and four-wire lines can be replaced by two-wire lines and the switches need only have a closing function for manual signalling, thus substantially halving the number of contacts.

The invention will be described in greater detail hereinbelow and with reference to the accompanying drawings, in which.

Figure 1:
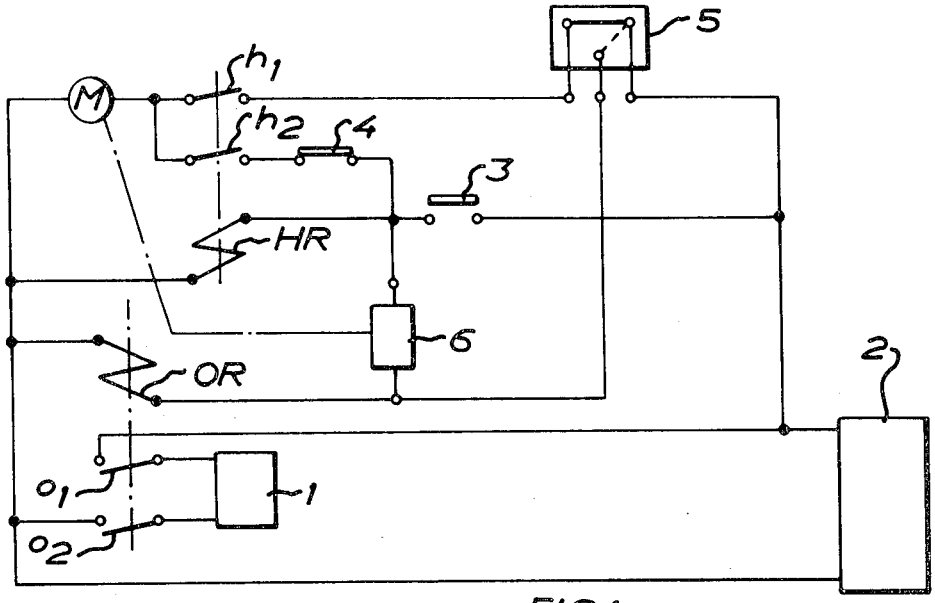
FIG. 1 shows a prior art signalling apparatus.
Figure 2:
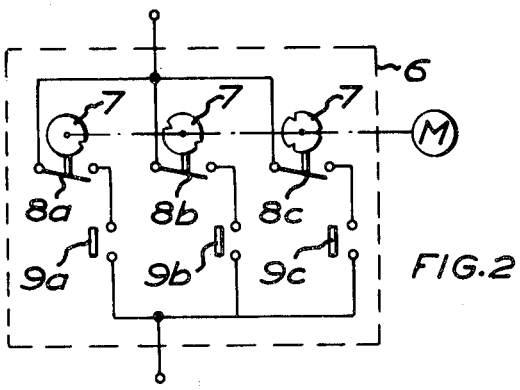
FIG. 2 shows a contact device for periodic establishment of a current path in the prior art signalling apparatus.
Figure 3:
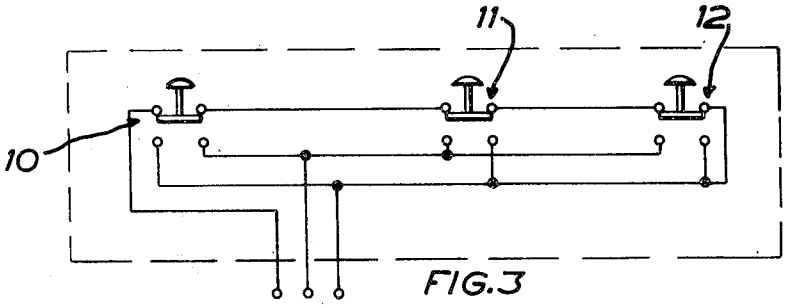
FIG. 3 shows the switches for manual signalling in the prior art signalling apparatus, located distally from the signalling apparatus.

The prior art signalling apparatus shown in FIGS. 1–3 has a signalling device 1 which can be of the acoustic type or a combination sound and light signalling device. The device 1 is connectable to a current source 2 by means of a first relay OR, and more precisely by means of the make contacts $o_1$ and $o_2$ controlled by this relay. A second relay HR in the apparatus is connectable to the current source 2 by an instantaneously closable manual switch 3 for starting the apparatus. The relay HR, with its own contacts $h_1$ and $h_2$ in series, establishes a holding current path via a manual circuit breaker 4 for cutting out the automatic function of the apparatus and a switch unit 5 which is schematically shown as a make-and-break contact in FIG. 1, while, in reality, having the form illustrated in FIG. 3. As the contact $h_1$ is closed, a motor M is connected to the current source 2, the motor thereby starting and actuating a contact means 6 which connects one side of the relay OR to the conductor connecting the relay HR and the starting switch 3. Moreover, said one side of the relay OR is connected to one of the two fixed contact members in the make-and-break contact 5, the other side of the relay being directly connected to the current source 2.

As shown in FIG. 2, the contact means 6 is provided with a plurality of cam discs 7 driven by the motor M, each of the discs, upon rotation, closing its contacts 8*a*-8*c* periodically and at different frequencies. The contacts 8*a*-8*c* are connected in parallel with each other and each in series with a manually closable selector switch 9*a*-9*c*, only one of which can be closed at a time. Naturally, more than three cam discs 7 can be provided.

The prior art switch unit 5 shown in FIG. 3 consists of a plurality of switches 10, 11 and 12 placed, for manual signalling, at suitable points throughout the ship, the switches being connected to each other and to the signalling apparatus by means of three and four-wire lines. Each of the switches 10, 11 and 12 has a manually operable movable contact member which, in the rest position of the switch, connects two first fixed contact members and in the operative position connects two other fixed contact members. The fixed contact members of the switches are connected to each other and to the signalling apparatus in the manner shown in FIG. 3 such that, when none of the switches 10, 11 and 12 is operative, the conductor from the relay contact $h_1$ is connected to one of the terminals of the current source 2, while when any one of the switches 10, 11 and 12 is operative, the relay OR is connected to said terminal of the current source 2.

The prior art signalling apparatus illustrated in FIGS. 1–3 operates in the following way. The apparatus is activated for automatic signalling by temporary closing of the starting switch 3, the relay HR being operated and establishing a holding current path via its contacts $h_1$ and $h_2$. The motor M is energized as a result of the closing of the contact $h_1$ and begins to turn the cam discs 7. Upon closing of any one of the selector switches 9*a*-9*c*, the relay OR will be energized intermittently at intervals determined by the form and speed of rotation of the cam discs 7. Thereby, the relay OR will, via its contacts $o_1$ and $o_2$, periodically connect the signalling device 1 to the current source 2.

On actuation of any one of the switches 10, 11 and 12, the holding current path for the relay HR passing the first fixed contact members of these switches will be broken, so that the relay HR is released, thereby stopping the motor M and breaking the circuit through the contact means 6. Moreover, the relay OR is connected across the second fixed contact members of the actuated switch, these members being now connected directly to the current source 2 so that the signalling device 1 is energized as long as the switch in question is actuated.

After manual signalling by means of any one of the switches 10, 11 and 12, a renewed energizing of the signalling apparatus by means of the starting switch 3 will be necessary for automatic signalling from the apparatus.

Figure 4:
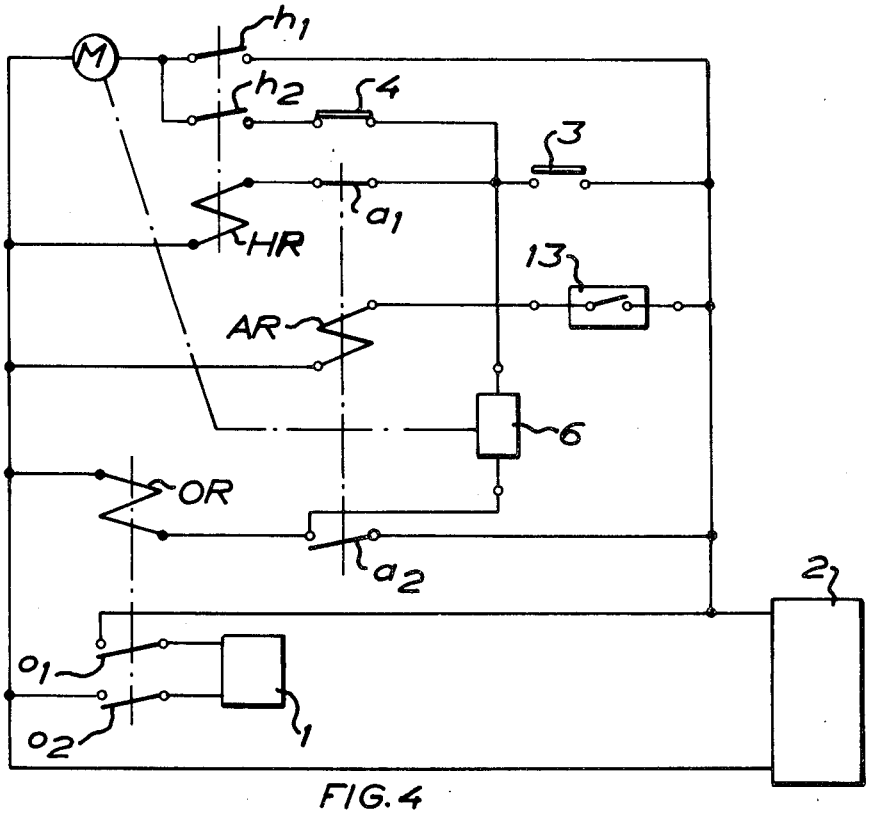
FIG. 4 shows a signalling apparatus including the improvement according to the present invention.

As shown in FIG. 4, the signalling apparatus according to the invention has several elements which are the same as those of FIG. 1 and have, therefore, been given the same reference numerals as in FIG. 1. These elements will not be described further.

According to the invention, the switch unit 5 of FIG. 4 is replaced by a relay AR and a switch unit 13 which are connected in series with the current source 2. The relay AR has a break contact $a_1$ connected into the holding current path of the relay HR and a make contact $a_2$ for connection of the relay OR direct to the current source 2.

Figure 5:
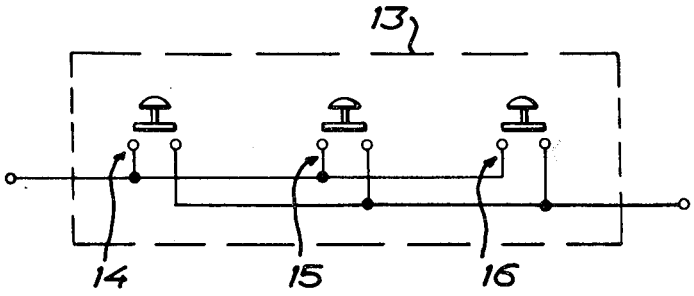
FIG. 5 shows the switches for manual signalling according to the present invention, located distally from the signalling apparatus.

The switch unit 13 is as shown in FIG. 5 and thus consists of a plurality of parallel-connected and manually closable switches 14, 15 and 16 which, like the switches 10, 11 and 12, are placed at suitable points throughout the ship while, as opposed to these switches, needing only two conductors for mutual connection and for connection to the remainder of the signalling apparatus.

The signalling apparatus of FIG. 4 operates in the same way as that of FIG. 1 with regard to its actuation for automatic signalling by means of the contact means 6. On manual closing of any one of the switches 14, 15 and 16 the relay AR is energized, its contact $a_1$ breaking the holding current path of the relay HR and stopping the motor M. At the same time, its contact $a_2$ connects the relay OR direct to the current source 2 instead of via the contact means 6, so that the signalling device 1 is also connected to the current source 2 via the contacts $o_1$ and $o_2$ as long as the switch in question remains closed. Repeated activation of the signalling apparatus by means of the starting switch 3 is necessary for subsequent automatic signalling with the use of the contact means 6.

The signalling device 1 can contain a group of several signal generators of different characteristics, for example, varying intensities and/or pitch. The desired signal generator or generators can be selected from the above-mentioned group by means of manually operable switches, for example switches 17 and 18 in the modification, shown in FIG. 6 of the signalling apparatus according to FIG. 4. As an example, the signalling device 1 in this modification has two signal generators 1*a* and 1*b* which are, thus, selectively connectable by means of the switches 17 and 18. In order to provide, on manual signalling, free choice between signal generators 1*a* and 1*b*, the relay AR (FIG. 4) is replaced by two relays AR*a* and AR*b* which are connected in series with switch units 13*a*, 13*b*, respectively (identical to the switch unit 13) to the current source 2. These two relays AR*a* and AR*b* each have a break contact $aa_1$ and $ab_1$, respectively, connected in series to the holding current path of the relay HR. The relays AR*a* and AR*b* do not, however, have any make contact for connection of the relay OR direct to the current source 2, each having instead two make contacts $aa_2$, $aa_3$ and $ab_2$, $ab_3$, respectively, for connection of the signal generators 1*a* and 1*b*, respectively, direct to the current source 2.

Figure 6:
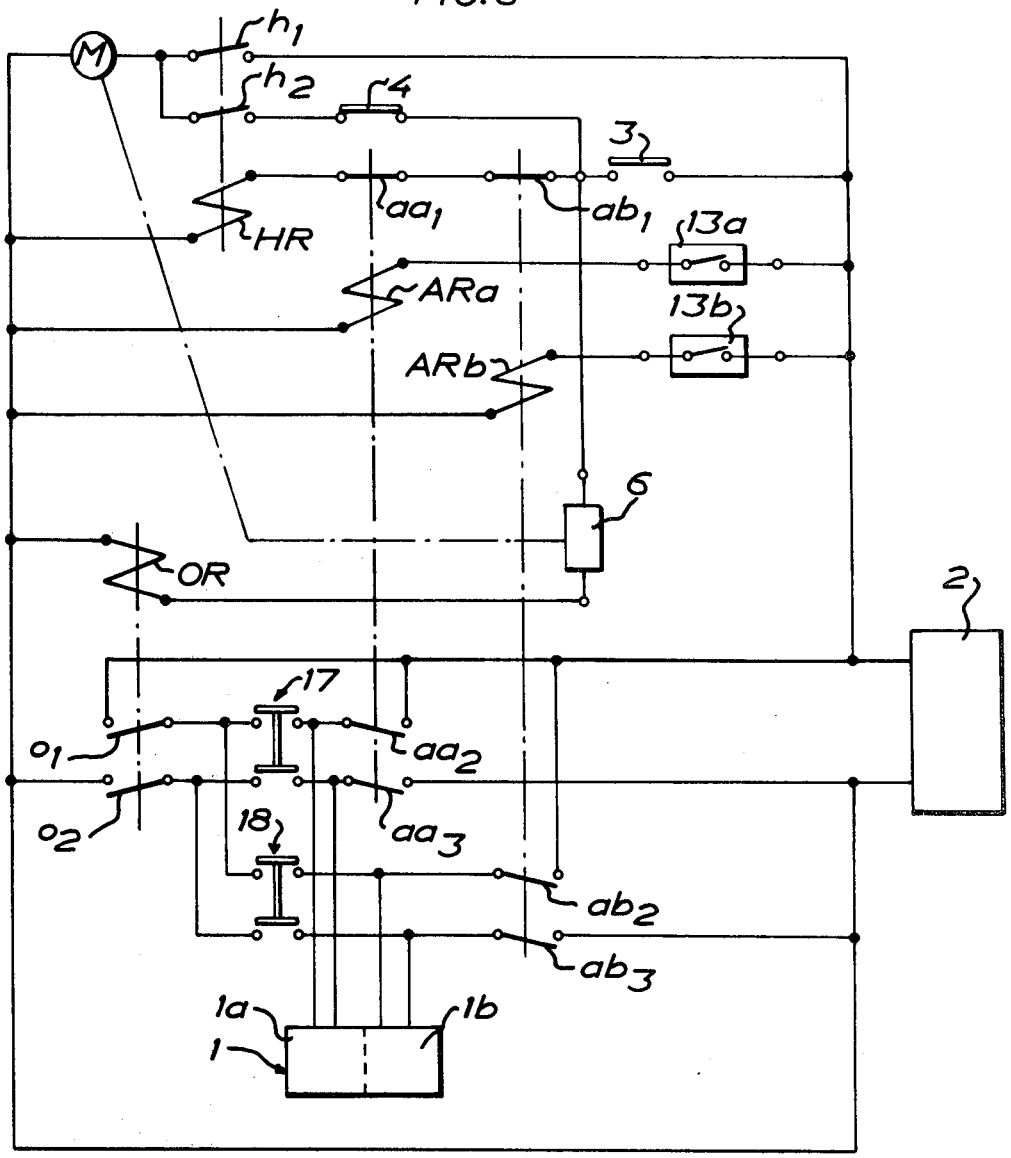
FIG. 6 shows a modification of the signalling apparatus of FIG. 4.

The modified signalling apparatus of FIG. 6 operates in exactly the same way as the apparatus according to FIG. 4, with the exception that the relay OR is only used in automatic signalling, choice of the signal generator being effected by means of the switches 17 and 18, while, on manual signalling, choice of the signal generator is effected by means of the switch units 13*a* and 13*b* and the selected signal generator or generators are directly connected to the current source 2 by means of the make contacts $aa_2$, $aa_3$ and $ab_2$, $ab_3$, respectively, of the relays AR*a* and AR*b*.

What we claim and desire to secure by letters Patent is:

1. In a signalling apparatus for ships, said apparatus being primarily intended for signalling in poor visibility and comprising a current source, an electric signalling device, a first relay for connecting said signalling device to said current source, a motor, a plurality of alternatively selectable make contacts which are periodically closable by means of said motor and are connected in parallel with each other and in series with said first relay to said current source, and a second self-holding relay for coupling said motor to said current source, the improvement comprising a plurality of parallel-connected switches for manual signalling and at least one third relay which is connected to said current source in series with said parallel-connected switches and has a break contact coupled into the holding current path of said second relay, and at least one make contact for connecting said signalling device to said current source.

2. An apparatus as claimed in claim 1, wherein the make contact of said at least one third relay is connected in series with said first relay to said current source to connect said signalling device to said current source indirectly via said first relay.

3. An apparatus as claimed in claim 1, wherein said at least one third relay has two make contacts which directly connect said signalling device to said current source.

4. An apparatus as claimed in claim 3 having several of said third relays, wherein the make contacts of said third relays each connect one of a plurality of signal generators included in said signalling device to said current source.

* * * * *